US011514773B2

(12) United States Patent
Deborgies et al.

(10) Patent No.: US 11,514,773 B2
(45) Date of Patent: Nov. 29, 2022

(54) SYSTEM AND METHOD FOR MONITORING A SITUATION WITHIN A VOLUME

(71) Applicant: KAPELSE, Villers les Nancy (FR)

(72) Inventors: Luc Deborgies, Versailles (FR); Flore Rocca, Vaucresson (FR)

(73) Assignee: KAPELSE, Villers les Nancy (FR)

( * ) Notice: Subject to any disclaimer, the term of this patent is extended or adjusted under 35 U.S.C. 154(b) by 0 days.

(21) Appl. No.: 17/414,088

(22) PCT Filed: Dec. 16, 2019

(86) PCT No.: PCT/EP2019/085423
§ 371 (c)(1),
(2) Date: Jun. 15, 2021

(87) PCT Pub. No.: WO2020/127099
PCT Pub. Date: Jun. 25, 2020

(65) Prior Publication Data

US 2022/0036719 A1 Feb. 3, 2022

(30) Foreign Application Priority Data

Dec. 21, 2018 (FR) ..... 18 73733

(51) Int. Cl.
*G08B 21/22* (2006.01)
*G08B 7/06* (2006.01)
(Continued)

(52) U.S. Cl.
CPC ..... *G08B 21/22* (2013.01); *G08B 7/06* (2013.01); *G08B 23/00* (2013.01); *G08B 25/10* (2013.01)

(58) Field of Classification Search
CPC ..... G08B 21/22; G08B 7/06; G08B 23/00; G08B 25/10; G08B 21/043; G08B 21/0446; G08B 21/0492; A61B 2560/04
See application file for complete search history.

(56) References Cited

U.S. PATENT DOCUMENTS 8,675,920 B2 * 3/2014 Hanson ..... A61B 5/0022 382/103
9,466,194 B1 * 10/2016 Kraz ..... G08B 21/14
(Continued)

FOREIGN PATENT DOCUMENTS

FR 2863396 A1 6/2005

*Primary Examiner* — John A Tweel, Jr.
(74) *Attorney, Agent, or Firm* — Craft Chu PLLC; Andrew W. Chu

(57) ABSTRACT

The device for monitoring a situation within a volume includes at least one electronic unit containing a plurality of different types of sensors, at least one program for controlling the sensors according to a predefined profile and a program for processing data recorded by the sensors, a device for signaling the detection of data representative of an event within the volume, a remote management unit and device for exchanging data between the electronic unit and the remote management unit defined by a radio transmitter/receiver that includes the electronic unit and the remote management unit. The electronic unit includes a device for manual activation of the radio emitter, defined by a button arranged on a housing for an infrared presence sensor equipped with its lens forming a protuberance on the outer face of the unit. The invention also concerns a method for monitoring a situation within the volume by the device.

11 Claims, 2 Drawing Sheets

(51) Int. Cl.
*G08B 23/00* (2006.01)
*G08B 25/10* (2006.01)

(56) References Cited

U.S. PATENT DOCUMENTS

| | | | | |
|---|---|---|---|---|
| 9,600,989 | B2 * | 3/2017 | Fadell | G08B 21/22 |
| 9,697,713 | B2 * | 7/2017 | Fadell | G08B 21/12 |
| 10,013,861 | B2 * | 7/2018 | Fadell | G08B 17/10 |
| 2012/0286949 | A1 | 11/2012 | Worthington et al. | |
| 2016/0203692 | A1 | 7/2016 | Ten Kate et al. | |

* cited by examiner

SYSTEM AND METHOD FOR MONITORING A SITUATION WITHIN A VOLUME

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The object of the present invention is, on the one hand, a device for remote monitoring or not of a state or situation within a given environment, such as for example the state of a frail person maintained at home, or the control of the environment, etc., and on the other hand a method for remote monitoring or not of a situation within a volume.

2. Description of Related Art Including Information Disclosed Under 37 CFR 1.97 and 37 CFR 1.98

At present, various more or less elaborate electronic devices, based on the implementation of data sensors and, if necessary, means of analysis of the data recorded, have been developed for this purpose, are already available on the market, and have been the subject of publications. In this regard, documents US 2016/0203692, FR 2 863 396 and US 2012/0286949 describe different solutions of this type, each dedicated to a particular application.

However, it has been observed that the various proposed devices suffer from a number of drawbacks, and do not always satisfactorily meet the expectations or needs of users.

Thus, the devices integrating only one type of sensor are by definition limited to the control of a single data and consequently unsuitable for complex applications requiring the follow-up of a plurality of different parameters.

On the other hand, devices that integrate a plurality of sensors are particularly energy consuming and generally take up a lot of space. In short, their installation is tedious, especially in environments requiring their discretion, and their implementation implies a permanent verification of the batteries' charge level, as well as a frequent replacement of the latter, in order to avoid any failure.

Furthermore, conventional systems rely on the transmission of raw data generated directly by the sensors to a possible analysis tool, without any special processing. In order for this raw data to be usable, relevant, and meaningful, it is necessary to have, in addition to the measuring device, an expert system deported to one or more servers. Such an architecture implies not only a very high initial cost, because of its heaviness, but also a complexity of implementation, due to the need to provide a computer server and the diversity of the dedicated sensors used, implying the same diversity in terms of communication protocols.

Also, it has been found that the implementation principle of some existing installations can be complex under certain circumstances, and lead to late reactions with detrimental consequences.

The purpose of the present invention is to overcome these various disadvantages, by proposing a solution that is both multi-purpose and energy-efficient, based on a compact data capture device, and a reliable, efficient and architecturally simplified data analysis system, which also differs from existing solutions in that it is more intuitive to use.

BRIEF SUMMARY OF THE INVENTION

In other words, the object of the invention is to provide a solution with a universal character, which is suitable for many different applications through a simple prior parameterization of the multiple sensors that it integrates, whose constituent elements allow a discreet installation, respectful of the environment of use, thanks to a minimalist size, whose autonomy is considerably improved compared to conventional solutions to extend up to three years with an ordinary type battery, and which comprises means of triggering alarms whose mode of implementation is obvious.

To this end, the object of the invention is a device for monitoring a situation within a volume, comprising at least one electronic unit containing:

- a plurality of sensors of different type,
- a microcontroller for managing the sensors comprising memory means,
- at least one program for controlling the sensors according to a predefined profile and a program for processing the data recorded by the sensors, stored in the said memory means,
- means for signaling the detection of data representative of the occurrence of a particular event within the volume,
- means for supplying electrical energy, and
- means for manual activation of the radio transmitter of the electronic unit, characterized in that the manual activation means are defined by a button arranged on a housing dedicated to an infrared presence sensor provided with its lens forming a protuberance on the outer face of the housing.

In accordance with a preferred variant, the sensors are chosen from the group comprising a temperature sensor, a humidity sensor, an accelerometer, a magnetometer, a vibration sensor, a luminosity sensor and an infrared presence sensor.

Of course, sensors of a different nature can also be provided through other alternative embodiments specifically adapted to the applications considered.

In accordance with the invention, it is also provided that the sensors are preferably of the very low energy consumption type.

An additional characteristic of the device according to the invention is represented by the fact that the means of signaling the detection of data representative of a particular event are defined by at least one indicator lamp, and/or an audible warning means.

Furthermore, a remote management unit and means for exchanging data between the electronic unit and the remote management unit can also complete the device according to the invention.

In this case, the remote management unit preferably comprises:

- a microcontroller for remote management of the electronic unit, comprising memory means,
- a program for remote selection of a particular sensor control profile, stored in the memory means, as well as a program for processing data transmitted by the electronic unit, and
- an interface for using the program for remote selection of a particular sensor control profile and/or the program for processing data transmitted by the electronic unit.

According to a conceivable option, the data exchange means are defined by a radio transmitter/receiver that the electronic unit and the remote management unit comprise.

Within the framework of the invention, it has also been imagined that the electronic unit comprises means for manual activation of the radio transmitter of the electronic unit.

These manual activation means can advantageously be defined by a button placed on a housing dedicated to an infrared presence sensor equipped with its lens forming a protuberance on the outer face of the unit.

Furthermore, the device according to the invention may also comprise a central unit and means for transmitting data between the said remote management unit and the said central unit.

The invention also relates to a method of monitoring a situation within a volume, by means of a device as previously described, characterized in that it comprises the following steps:

- a plurality of profiles is defined, each grouping a set of parameters specific to a given application of the electronic unit,
- the plurality of profiles is stored in the sensor control program within the electronic unit,
- the electronic unit is installed in the volume to be monitored,
- one of the profiles is selected to automatically activate at least one of the sensors of the electronic unit,
- a signal is recovered which is representative of the occurrence of an event within the volume, and whose emission is caused by the detection of a data item, as the case may be, recorded by one of the sensors or resulting from the processing of the data recorded by at least one of the sensors, and corresponding to a data item known as "threshold data".

In accordance with a characteristic of the method, in order to define the plurality of profiles, the following is established for each of them:

- a list of automatically activated sensors,
- a frequency of measurements for each of the automatically activated sensors,
- a list of values from which a data item recorded by one of the automatically activated sensors or resulting from the processing of data recorded by the automatically activated sensors corresponds to a "threshold data item".

A subsidiary characteristic is further defined by the fact that, in order to define the plurality of profiles, the following is also established for each of them:

- a list of subsidiary sensors that can be automatically activated in the event of detection, by at least one automatically activated sensor, of data corresponding to a threshold data, and/or
- a list of sensors whose frequency of measurements can be automatically modified in the event of detection, by at least one automatically activated sensor, of data corresponding to a threshold data.

It has also been imagined that the signal representative of the occurrence of an event within the volume can be recovered from the electronic unit and/or from the remote management unit.

As the case may be, the signal representative of the occurrence of an event may be retrieved in the form of a light signal and/or a sound signal and/or a time-stamped message contained in a primary computer frame.

In addition, the method according to the invention may comprise a step consisting of retrieving periodically, at the remote management unit, all the data read by the sensors and/or all the data processed by the data processing program in the form of a time-stamped message contained in a secondary computer frame.

The latter can be recovered manually by a step of activating the button on the electronic unit.

Alternatively, the secondary computer frame can be recovered automatically by integrating, during the step of defining the profiles, in each of these profiles, a transmission frequency of all the data recorded by the sensors and/or all the data processed by the data processing program, from the electronic unit to the remote management unit.

BRIEF DESCRIPTION OF THE SEVERAL VIEWS OF THE DRAWINGS

The invention will be better understood, and other features and advantages of the invention will become apparent from the following description of two non-limiting examples of implementation of the method according to the invention.

The description should be read in conjunction with the attached drawings.

FIG. 1 also includes enlarged schematic views of embodiments of the electronic units 2.

DETAILED DESCRIPTION OF THE INVENTION

Figure 1:
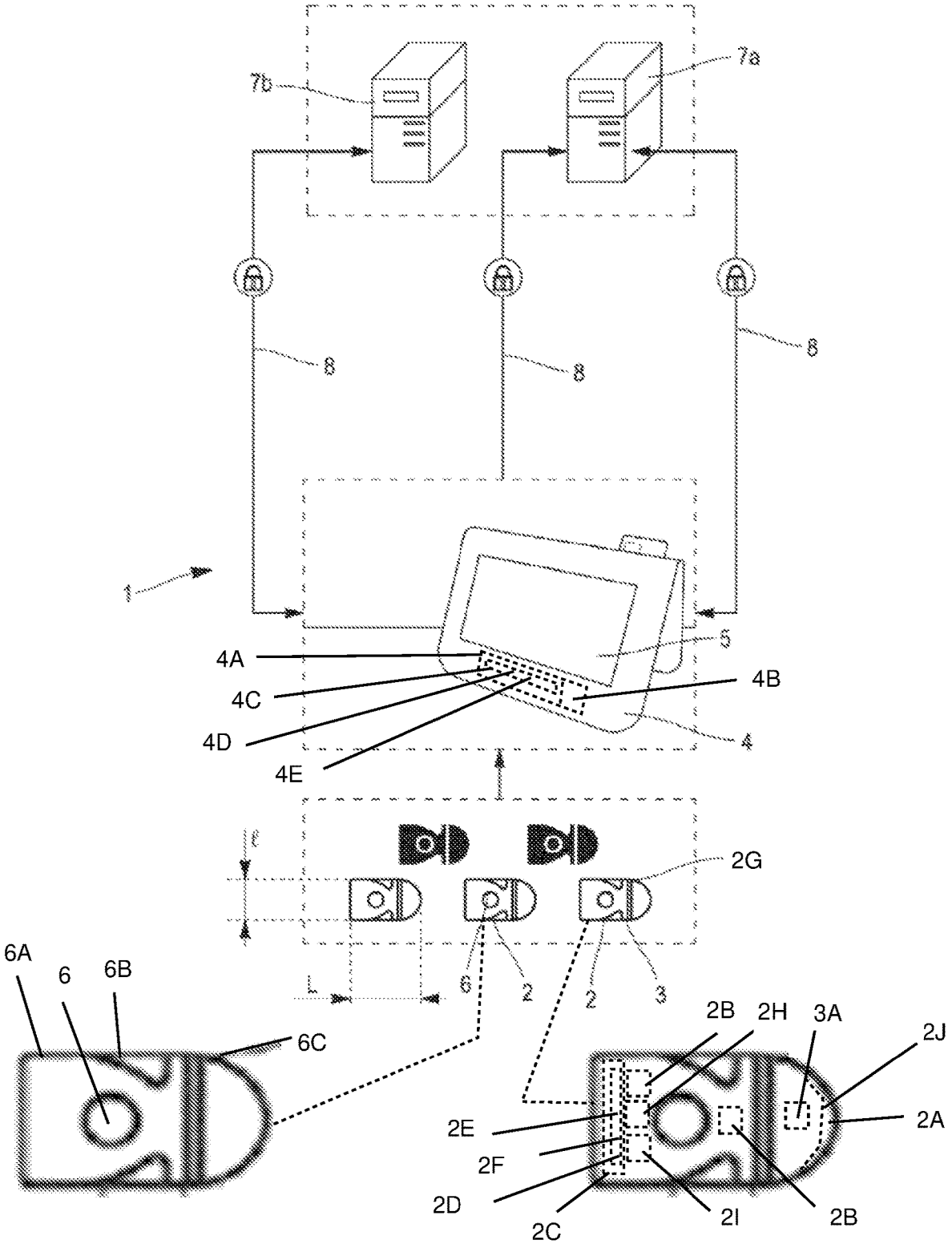
FIG. 1 is a schematic view of a diagram of an alternative embodiment of the device according to the invention, suitable, for example, for monitoring the entry/exit of a person from a living volume.

In the alternative embodiment shown in FIG. 1, the system 1 according to the invention comprises a plurality of multi-purpose electronic units 2, intended to be installed within a volume to be monitored, such as for example a living space, and capable of detecting a certain number of physical quantities there, through the implementation of different sensors.

Figure 2:
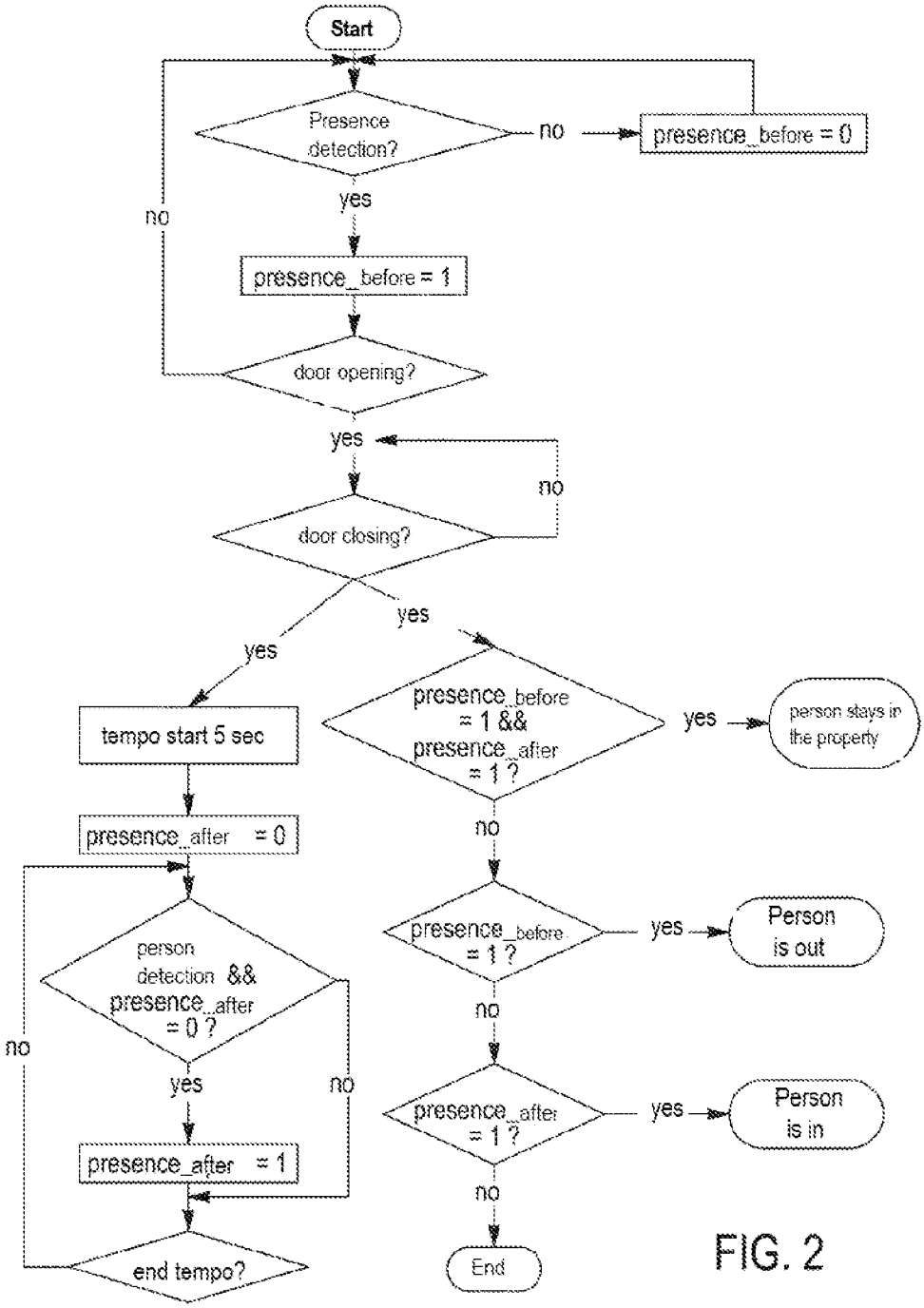
FIG. 2 is a flow chart of the implementation method of the device of FIG. 1, applied to the monitoring of the entries/exits of a person from a living volume.

In order to contribute to this versatility and to allow a reliable monitoring, each electronic unit of the electronic units 2 embeds, in a standard way, on the same electronic card a first unit sensor 2A selected from a group consisting of: a temperature sensor, a humidity sensor, an accelerometer, a magnetometer, a vibration sensor, a luminosity sensor and an infrared presence sensor and a second unit sensor 2B selected from a group consisting of: a temperature sensor, a humidity sensor, an accelerometer, a magnetometer, a vibration sensor, a luminosity sensor and an infrared presence sensor. Any additional sensor is also selected from a group consisting of: a temperature sensor, a humidity sensor, an accelerometer, a magnetometer, a vibration sensor, a luminosity sensor and an infrared presence sensor. The first unit sensor 2A is different from the second unit sensor 2B. In the embodiment of FIG. 2, the first unit sensor is an infrared presence sensor.

Of course, this list of sensor types must be interpreted as being specific to the alternative embodiment described and is likely to evolve according to the targeted applications.

In this case, any data recorded by an additional sensor (the second unit sensor 2B) integrated into each electronic unit of the plurality of electronic units 2 will be processed by the same on-board intelligence as those recorded by the other sensors (the first unit sensor 2A and the second unit sensor 2B, and any other sensors). However, as will be described in more detail below, all the sensors (the first unit sensor 2A and the second unit sensor 2B, and any other sensors) embedded in the same unit 2 are not necessarily activated permanently, but only when the application in question requires it, or when a data item detected by an already active sensor causes them to be activated, which represents an undeniable advantage in terms of energy savings.

Furthermore, with the same objective of limiting the energy consumption of the device according to the invention as much as possible, the sensors (the first unit sensor 2A and the second unit sensor 2B, and any other sensors) installed on the electronic unit 2 are of the very low energy consumption type.

It should also be noted that the electronic units 2 advantageously present a very compact structure, and very small dimensions (of the order of 3 cm width I and 5 cm length L, in the shown example), conferring great discretion and facilitating both their installation and their integration in a volume, such as a living space in which a given situation is to be monitored.

Each electronic unit of the plurality of electronic units 2 is equipped with a unit microcontroller 2C for managing the sensors (the first unit sensor 2A and the second unit sensor 2B, and any other sensors). The microcontroller 2C is comprised of a unit memory means 2D in which are stored at least one program for controlling the sensors (a sensor control program 2E) according to a predefined profile and a program for processing the data recorded by the sensors (a sensor data processing program 2F). Each electronic unit of the plurality of electronic units 2 is further comprised of a signaling means or means for signaling 2G in communication with the unit microcontroller, selected as one of a group consisting of a lamp 3, an audible warning means 3A. The electrical power supply 2H in communication with the unit microcontroller of each electronic unit of the plurality of electronic units 2 is ensured by a conventional battery, of the 3V-600 mAh type.

In the alternative embodiment shown, the system, according to the invention, also comprises a remote management unit 4, equipped with a remote management microcontroller 4A for remote management of the plurality of electronic units 2, the remote management microcontroller 4A comprising a remote management memory means 4C in which a program for remote selection of a particular sensor control profile (remote selection of profile program 4D) is stored, as well as an interface 5 for using the remote selection of profile program.

Moreover, in order to authorize an exchange of data between the remote management unit 4 and the electronic units 2, each of them integrates a radio transmitter/receiver (unit radio transmitter/receiver 2I, remote management radio transmitter/receiver 4B). It is also specified that all of these exchanges are preferably encrypted to ensure their security and confidentiality.

In addition, each electronic unit of the plurality of electronic units 2 comprises a button 6, advantageously arranged on a unit housing 6A. The first unit sensor 2A being an infrared presence sensor provided with a lens 2J forming a protuberance 6C on an outer face 6B of the unit housing 6A, the button 6 defining a means of manual activation of the radio transmitter (unit radio transmitter/receiver 2G) that it integrates.

The system 1 can further comprise two central units 7*a*, 7*b*, capable of communicating with the remote management unit 4, by means of secure data transmission 8 based on encryption of the transmitted radio data, as shown in FIG. 1. They perform various functions, comprising in particular the storage of data relating to the management of the electronic units 2 and of the remote management unit 4, and the updating of the programs that this equipment incorporates.

In order to achieve the above-mentioned objectives, aiming in particular at providing a solution with a universal vocation, and very economical in terms of energy, the implementation of the device 1 according to the invention is via an innovative process which allows both to optimize the operating times of the sensors and to limit the transmission of information or the exchange of data to only those which are useful.

Within the framework of this method, each electronic unit 2 is provided with a library of profiles, previously defined, each grouping a set of parameters specific to a given application and making it possible to dedicate the units 2 to multiple uses, by the prior selection of the corresponding profile.

More precisely, in order to define the plurality of profiles likely to be stored in each electronic unit 2, a list of automatically activated sensors, a frequency of measurement readings for each of the "automatically" activated sensors, and a list of values from which a data item read by one of the automatically activated sensors or resulting from the processing of data read by the automatically activated sensors corresponding to a "threshold data item" is established for each of them.

In practice, the profile selection step is preferably carried out after the installation of the electronic unit(s) 2 in the volume to be monitored, for example by means of a remote management unit 4 and leads to the activation of only those sensors required by the application in question.

In other words, for each application, the sensor control program of the electronic unit(s) 2 will exploit the relevant profile to automatically activate one or more sensors that will operate in accordance with the parameters of this same profile.

During the monitoring method, the data recorded by the sensors is analyzed within the electronic unit 2, by the data processing program that it integrates, and is compared with the data, called "threshold data", recorded in the profile.

In order to limit the electrical energy consumption of the device according to the invention, a signal representative of the occurrence of an event within the monitored volume is then recovered only in the event of the detection of a data which turns out, according to the case before or after analysis, to correspond to a "threshold data".

Thus, depending on the case, the occurrence of an event can be signaled through a signal whose emission is activated by the detection of a raw data, or a processed data, each corresponding to a threshold data.

Furthermore, the invention is also based on a dynamic and permanent optimization of the intelligence embedded in the electronic unit 2, which induces an interoperability of the sensors integrated in this same electronic unit 2 and a correlation of the data recorded by each of them.

Indeed, the invention provides that for certain profiles recorded in the memory means of the electronic unit 2, a list of subsidiary sensors likely to be activated automatically, in the event of detection, by at least one automatically activated sensor, of data corresponding to a threshold data, and/or a list of sensors whose frequency of measurement readings is likely to be modified automatically in the event of detection, by at least one automatically activated sensor, of data corresponding to a threshold data, is also established for each of them.

Such a characteristic also makes it possible to limit the electrical energy requirements of the device 1 according to the invention, the sensors only coming out of their standby mode at specific times, defined by the profile parameters, and remaining inactive, and therefore not supplied with energy, the rest of the time.

The method according to the invention also provides for the possibility of recovering the signal representing the occurrence of an event within the volume directly by an electronic unit 2, in the form of a light signal and/or a sound signal, and/or by a remote management unit 4, in the form of a time-stamped message contained in a primary computer frame. The method includes the steps of activating the system 1, defining a plurality of profiles with the remote management unit, each profile grouping a set of parameters specific to a given application of the electronic unit, installing the electronic unit in the volume to be monitored, selecting one profile of the plurality of profiles, activating sensors according to the one profile so as to determine activated sensors, the first unit sensor being one of the activated sensors, recording data by the activated sensors, processing the data so as to determine a data item, detecting when the data item corresponds to the threshold data item so as to determine the occurrence of an the event within the volume and signaling so as to indicate the occurrence of the event within the volume.

Of course, it is also possible to periodically retrieve, at the remote management unit 4, in the form of a time-stamped message contained in a secondary computer frame, all of the raw data recorded by the sensors and/or all of the data processed by the data processing program (electronic unit data processing program 4E) of each electronic unit 2. This step can be carried out manually, by activating the button 6 on the electronic unit 2. According to another option, it can also be carried out automatically, by integrating in each of the profiles a transmission frequency, from the electronic unit 2 to the remote management unit 4, of all the raw data recorded by the sensors and/or all the data processed by the data processing program.

When the device 1, according to the invention, comprises a plurality of electronic units 2, it is advantageously provided that the occurrence of an event within the volume can be detected by the remote management unit 4, following a computer processing of the data contained in the primary and/or secondary computer frames from each of the units 2. In short, the aggregation and processing of data from different units 2 installed in a volume and, if necessary, parameterized for different applications, at the remote management unit 4, allows the detection by the latter, of the occurrence of an event which might have escaped a unit 2 considered in isolation.

It is clear from the foregoing that the device 1 according to the invention makes it possible to achieve the objectives stated in the preamble.

Thanks to the implementation of a library of profiles, each representative of a different application, the device according to the invention is universal. It can, for example, be placed in a living volume and, following the activation of the corresponding profile, retrieve environmental data such as temperature, humidity, and luminosity, as well as the state of occupation of this same volume. An installation on a drawer or a cupboard allows, according to another example of implementation, to detect the openings and closings of these, again after selection of the corresponding profile and thus activation of the required sensors. Placed in a refrigerator, the device according to the invention makes it possible to monitor the temperature inside the refrigerator at regular intervals and to alert the user in the event that the temperature exceeds a monitoring range, also by selecting the profile provided for this purpose.

The device according to the invention is also evolutive, since it can be used for a certain period of time for a first application, then for a second application during a second period, etc., by simply reprogramming and selecting a different profile.

Furthermore, thanks to the compact structure and reduced dimensions of the electronic unit 2, the device 1 according to the invention is discrete and does not alter the general ambiance of the environment in which it is installed.

Because all the sensors are of the low energy consumption type and are only activated when needed and the signals are only emitted when an alarm is detected, it is energy efficient and can last up to three years.

In this respect, it should also be noted that within the framework of the invention, it may be provided to determine permanently the energy expended by the electronic unit 2 and consequently to deduce from it the remaining charge as well as the duration of operation, in order to be able to anticipate the recharging or the replacement of the battery and to avoid any untimely failure.

Also, the electronic unit 2 is preferably equipped with a USB connector (universal serial bus) allowing it to be coupled with a remote management unit 4 that can be defined by any current computer equipment equipped with a USB socket, such as a personal computer, an internet unit, etc.

FIG. 2 attached illustrates the logic implemented by the process according to the invention, in the context of the use of the device 1 to monitor the entries and exits of a person from a living volume, and the duration of inoccupation of this same living volume, after the person has left. This figure also illustrates the nature of the information deduced from the data recorded by the sensors and constituting messages representative of a situation.

In such an application, the selected profile must allow a necessary and sufficient feedback of door movements and presence data to be informed of the entries and exits of a person from his home or from a specific volume of the latter. It must also allow to estimate the time of occupation or non-occupation of a volume, in order to deduce the location and the movements of a person within his home.

For this purpose, the activation of the infrared presence sensor, the accelerometer (translation detection) and the magnetometer (rotation detection) is necessary. Furthermore, the corresponding profile integrates a certain number of parameters, relating in particular to the nature of the door, to the duration of opening of the door corresponding to a threshold data, to the readings which trigger, after correlation with other data read by other sensors, the emission of a signal or even to the quantity of movements which must be detected to validate a presence in the volume and thus the emission of a signal.

In accordance with the invention, in this application, the autonomy of the device 1 is prolonged thanks to a correlation between the door movement information (translation/rotation) and the presence information. Thus, for example, when no presence in a volume is detected, the measurement frequency of the accelerometer and magnetometer is automatically reduced. In the same way, the frequency of the measurements taken by the presence detector can be modified according to the occupancy rate of the volume detected.

We claim:

1. A system for monitor, comprising:

an electronic unit being comprised of:

a first unit sensor of a plurality of sensors;

a second unit sensor of said plurality of sensors, said first unit sensor being different from said second unit sensor;

a unit microcontroller being connected to said plurality of sensors so as to manage said plurality of sensors, wherein said unit microcontroller is comprised of:

a unit memory means;

a sensor control program being stored in said unit memory means so as to control the plurality of sensors according to a predefined profile; and a sensor data processing program being stored in said unit memory means so as to process data recorded by the plurality of sensors;

means for signaling in communication with said unit microcontroller so as to indicate a detection of data representative of an occurrence of a particular event within a volume; and means for supplying electrical energy in communication with said unit microcontroller;

a remote management unit being in communication with said electronic unit;

means for exchanging data between the electronic unit and the said remote management unit, wherein said electronic unit is further comprised of a unit radio transmitter/receiver in communication with said unit microcontroller, and wherein said remote management unit is comprised of a remote management radio transmitter/receiver, the means for exchanging data being comprised of said unit radio transmitter/receiver and said remote management radio transmitter/receiver; and means for manual activation of said unit radio transmitter/receiver, wherein said electronic unit is further comprised of a unit housing having an outer face, and a button arranged on said unit housing, the means for manual activation means being comprised of said button, wherein said first unit sensor is an infrared presence sensor provided with a lens so as to form a protuberance on said outer face, and wherein said remote management unit further comprises:

a remote management microcontroller so as to remotely manage said electronic unit, wherein said remote management microcontroller is comprised of:

a remote management memory means;

a remote selection of profile program being stored in said remote management memory means so as to remotely select a particular sensor control profile; and an electronic unit data processing program being stored in said remote management memory means so as to process data transmitted by said electronic unit; and an interface in communication with the remote selection of profile program and the electronic unit data processing program.

2. The system, according to claim 1, wherein said second unit sensor is selected from a group consisting of: a temperature sensor, a humidity sensor, an accelerometer, a magnetometer, a vibration sensor, a luminosity sensor, and an infrared presence sensor.

3. The system, according to claim 1, wherein the plurality of sensors have a power consumption level.

4. The system, according to claim 1, wherein the means for signaling being comprised of at least one of a group consisting of: an indicator lamp, and a sound warning means.

5. The system, according to claim 1, further comprising: at least one central unit and means for transmitting data between said remote management unit and said central unit.

6. A method for monitoring, comprising the following steps:

activating a system, comprising:

an electronic unit being comprised of:

a first unit sensor of a plurality of sensors;

a second unit sensor of said plurality of sensors, said first unit sensor being different from said second unit sensor;

a unit microcontroller being connected to said plurality of sensors so as to manage said plurality of sensors, wherein said unit microcontroller is comprised of:

a unit memory means;

a sensor control program being stored in said unit memory means so as to control the plurality of sensors according to a predefined profile; and a sensor data processing program being stored in said unit memory means so as to process data recorded by the plurality of sensors;

means for signaling in communication with said unit microcontroller so as to indicate a detection of data representative of an occurrence of a particular event within a volume; and means for supplying electrical energy in communication with said unit microcontroller;

a remote management unit being in communication with said electronic unit;

means for exchanging data between the electronic unit and the said remote management unit, wherein said electronic unit is further comprised of a unit radio transmitter/receiver in communication with said unit microcontroller, and wherein said remote management unit is comprised of a remote management radio transmitter/receiver, the means for exchanging data being comprised of said unit radio transmitter/receiver and said remote management radio transmitter/receiver; and means for manual activation of said unit radio transmitter/receiver, wherein said electronic unit is further comprised of a unit housing having an outer face, and a button arranged on said unit housing, the means for manual activation means being comprised of said button, and wherein said first unit sensor is an infrared presence sensor provided with a lens so as to form a protuberance on said outer face;

defining a plurality of profiles with said remote management unit, each profile grouping a set of parameters specific to a given application of said electronic unit, wherein the parameters of said set of parameters are comprised of:

a list of automatically activated sensors of said plurality of sensors, a frequency of measurements for each of the automatically activated sensors, and a list of values corresponding to a threshold data item, and wherein said plurality of profiles is stored in said sensor control program, installing said electronic unit in the volume to be monitored, selecting one profile of the plurality of profiles;

activating sensors according to said one profile so as to determine activated sensors, said first unit sensor being one of said activated sensors;

recording data by said activated sensors;

processing said data so as to determine a data item;

detecting when said data item corresponds to said threshold data item so as to determine the occurrence of the event within the volume; and signaling so as to indicate the occurrence of the event within the volume, wherein the parameters of the set of parameters is further comprised of at least one list selected from a group consisting of:

a list of subsidiary sensors of said plurality of sensors, said subsidiary sensor being activated automatically when said data item corresponds to said threshold data item; and a list of modified sensors of said plurality of sensors, each modified sensor of said modified sensors having a measurement reading frequency automatically modified when said data item corresponds to said threshold data item.

7. The method, according to claim 6, wherein the step of signaling is by said electronic unit.

8. The method, according to claim 7, wherein the step of signaling is comprised of at least one of the following steps: emitting a light signal; emitting-a sound signal, and sending a primary time-stamped message contained in a primary computer frame.

9. The method, according to claim 6, wherein said remote management unit further comprises:

a remote management microcontroller so as to remotely manage said electronic unit, wherein said remote management microcontroller is comprised of:

a remote management memory means;

a remote selection of profile program being stored in said remote management memory means so as to remotely select a particular sensor control profile; and an electronic unit data processing program being stored in said remote management memory means so as to process data transmitted by said electronic unit; and an interface in communication with the remote selection of profile program and the electronic unit data processing program, the method further comprising the step of:

recovering the data from said sensor data processing program and said electronic unit data processing program as a secondary time-stamped message contained in a secondary computer frame.

10. The method, according to claim 9, wherein the step of recovering the data is comprised of the step of: manually by activating said button.

11. The method, according to claim 9, wherein the step of recovering the data has a frequency of transmission according to said one profile.

* * * * *